United States Patent [19]

Welgemoed et al.

[11] Patent Number: 4,732,666

[45] Date of Patent: Mar. 22, 1988

[54] FROTH FLOTATION

[75] Inventors: Jacobus C. Welgemoed, Sasolburg; Haimi N. Singer, Parktown; Phillip M. Viviers, Sasolburg, all of South Africa

[73] Assignee: Sentrachem Limited, Johannesburg, South Africa

[21] Appl. No.: 920,259

[22] Filed: Oct. 16, 1986

[30] Foreign Application Priority Data

Oct. 25, 1985 [ZA] South Africa ..... 85/8208

[51] Int. Cl.[4] ..... B03D 1/02

[52] U.S. Cl. ..... 209/166; 252/61

[58] Field of Search ..... 209/166, 167; 252/61

[56] References Cited

U.S. PATENT DOCUMENTS

| | | | |
|---|---|---|---|
| 2,302,338 | 11/1942 | Moeller | 209/166 |
| 4,211,644 | 7/1980 | Wiechers | 209/166 |
| 4,309,282 | 1/1982 | Smith | 209/166 |
| 4,556,545 | 12/1985 | Cheruvu | 209/166 |

FOREIGN PATENT DOCUMENTS

| | | | |
|---|---|---|---|
| 326417 | 7/1970 | Sweden | 209/166 |
| 688235 | 5/1975 | U.S.S.R. | 209/166 |
| 839570 | 7/1979 | U.S.S.R. | 209/166 |

*Primary Examiner*—S. Leon Bashore
*Assistant Examiner*—Thomas M. Lithgow
*Attorney, Agent, or Firm*—Fitch, Even, Tabin & Flannery

[57] ABSTRACT

A process for recovering phosphate values from a finely divided ore containing the phosphate values and gangue such as an ore containing apatite, calcite and dolomite, by froth flotation includes the steps of suspending the finely divided ore containing the phosphate values and the gangue in a liquid at a pH of greater than 7; adding to the suspension a froth flotation collector comprising a tall oil fatty acid and an emulsifier for the tall oil fatty acid selected from alkylphenylalkoxylates having the formula:

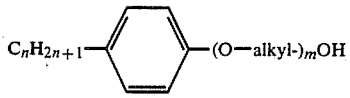

wherein:

n is an integer from 8–10 inclusive;

m is an integer from 10–20 inclusive; and alkyl is —$CH_2$—$CH_2$— or

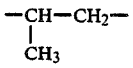

the froth flotation collector comprising 80–99% by weight of the collector of the tall oil fatty acid and 20 to 1% by weight of the collector of the emulsifier; introducing a gas such as air into the liquid to produce a froth containing the phosphate values and leaving suspended the other solid gangue; and recovering the phosphate values.

12 Claims, No Drawings

FROTH FLOTATION

BACKGROUND OF THE INVENTION

This invention relates to a process for recovering phosphate values from a finely divided ore containing the phosphate values and gangue by froth flotation.

Flotation is a process of treating a mixture of finely divided mineral solids, e.g. a pulverulent or finely ground ore, suspended in a liquid whereby a portion of such solids is separated from other finely divided solids, e.g. clays and other like materials present in the ore by introducing a gas (or providing a gas in situ) in the liquid to produce a frothy mass containing certain of the solids on the top of the liquid and leaving suspended (unfrothed) the other solid components of the ore. Flotation is based on the principle that introducing a gas into a liquid containing particles of different materials suspended therein causes adherence of some gas to certain suspended solids and not to others and makes the particles having the gas thus adhered thereto lighter than the liquid. Accordingly, these particles rise to the top of the liquid to form a froth.

Agents known as collectors are used in conjunction with flotation to promote recovery of the desired material. These agents have the ability of selectively attaching themselves to the particles of the desired material and improving the affinity of those particles for the gas bubbles.

Froth flotation is the main method used in South Africa for separating phosphates from its associated gangue. The collector which is invariably used is a fatty acid, particularly tall oil fatty acid. Typically recoveries of phosphate of the order of 60% are achieved using this known method.

USSR Pat. No. 688,235 (Chemical Abstracts Vol. 91,1979 195331t) discloses a process whereby phosphate containing minerals are floated from silicate-carbonate-type ores with high dolomite content with a fatty acid collector in an alkaline medium, conditioned with gelatinized starch. The process is improved using a mixture of the fatty acid collector with an alkyl hydroxamate, hydroxyethylated alkyl phenols, and nonpolar oil in the proportion of 0.75–1.25: 1.5–2.5: 0.75–1.25: 0.75–1.25.

Swedish Pat. No. 326,417 (Chemical Abstracts Vol. 77,1972 64149c) discloses that the selectivity for separating from apatite by flotation is considerably increased in an acidic medium. The mineral is treated with a hydrophobizing collector and then flotation is carried out at an initial pH of 2–4, which is allowed to increase to 6–7 during flotation. The hydrophobizing agent contains saturated or unsaturated $C_{8-24}$ fatty acids. Advantageously, a surfactant (oil soluble alkylbenzenesulfonates, alkylsulfates, or nonionics) is added as an emulsifier, and pine acid, tar acid or iso alcohol as a frother. This mehod can be combined with other flotation methods by which silicates and silica are removed before the calcite by using the same collector in an alkaline medium. In an example, 100 g of a phosphate mineral (particle size 40–50 μm) containing approximately 20% $P_2O_5$ and calcite impurities not removable by alkaline flotation was conditioned into a 70% pulp in the presence of 2500 g of tall oil fatty acid per ton of mineral. This was added as a 1% emulsion with the aid of 5% of a 1:16 nonylphenol-ethylene oxide condensate.

Sufficient water was added to give a pulp weighing 3200 g and the system was acidified with dilute HC1 to a pH of 2.5. After addition of 40 ppm 1:10 nonylphenol-ethylene oxide condensate as a frother, flotation for 30 minutes yielded 75.3% residue containing 24.0% $P_2O_5$.

Although various methods for the flotation of phosphate values from a phosphate containing ore are known, new processes are always needed. This is particularly so because the complexity and diversity of the interactions that can occur between reagents and minerals during the flotation process are such that understanding of this subject is still very inadequate. In practise virtually every mineral deposit requires its own unique flotation circuit and reagent suite.

SUMMARY OF THE INVENTION

According to the invention there is provided a process for recovering phosphate values from a finely divided ore containing the phosphate values and gangue by froth flotation which includes the steps of:

(1) suspending the finely divided ore containing the phosphate values and the gangue in a liquid at a pH of greater than 7;

(2) adding to the suspension a froth flotation collector comprising:

(a) a tall oil fatty acid; and (b) an emulsifier for the tall oil fatty acid selected from alkylphenylalkoxylates having the formula:

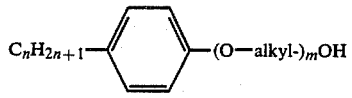

wherein:

n is an integer from 8–10 inclusive;

m is an integer from 10–20 inclusive; and alkyl is $—CH_2—CH_2—$ or

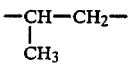

the froth flotation collector comprising 80–99% by weight of the collector of the tall oil fatty acid and 20 to 1% by weight of the collector of the emulsifier;

(3) introducing a gas into the liquid to produce a froth containing the phosphate values and leaving suspended the other solid gangue; and (4) recovering the phosphate values.

DETAILED DESCRIPTION OF THE INVENTION

The tall oil fatty acid and the emulsifier therefor are preferably mixed with each other and then added to the suspension in step (2).

The emulsifier, i.e. the alkylphenylalkoxylate is preferably an alkylphenylethoxylate having 12–15 ethoxylate groups, more preferably nonylphenylethoxylate having 14 ethoxylate groups.

The froth flotation collector preferably comprises 90–95% by weight of the collector of tall oil fatty acid and 10–5% by weight of the collector of the emulsifier.

The froth flotation collector is preferably added to the finely divided ore in an amount such that it provides from 200 to 600 g, more preferably 260 g of the tall oil fatty acid per ton of the ore and 10 to 120 g more preferably 13 g of the alkylphenylalkoxylate per ton of the ore.

The ore is preferably ground until at least 70% of the particles have a size of less than 212 μm. More preferably, the ore is ground until at least 90% of the particles have a size of less than 425 μm.

The ore may be any ore which contains phosphate values. The ore will generally include at least apatite, calcite and dolomite. The ore may also include one or more of phlogopite, serpentyn, diopside and pyroxenite.

The process must be carried out at a pH of greater than 7, preferably at a pH of 8 to 11.

Prior to step (2), the suspension of the ore in the liquid e.g. water, may be conditioned with a suitable amount of sodium silicate.

In step (3), the gas which is introduced into the liquid, (which includes forming the gas in situ) will generally be air.

Known froth flotation modifiers and agents for selectively wetting the gangue may also be added during the process. An example of such an agent is nonylphenylethoxylate containing 4 ethoxylate groups. It is to be noted that this agent does not function as an effective emulsifier for fatty acids.

An example will now be given which compares the process of the present invention, and in particular the use of a froth flotation collector as described above with a process in which there is used simply tall oil fatty acid on its own.

The ore to be treated comprised the following:

Apatite (calcium phosphate) by weight—22%
Phlogopite by weight—8%
Serpentyn by weight—7%
Diopside by weight—3%
Calcite (calcium carbonate) by weight—41%
Dolomite (a calcium and magnesium carbonate) by weight—12%
Pyroxenite by weight—7%

The ore was milled to approximately the following sizes:

10+425 μm±8.6%
+300 μm±19.4%
−212 μm±60.0%
−38 μm±12.0%

The milled ore was placed in a flotation cell and was suspended in a suitable liquid, e.g. water. The ore was then conditioned with 400 g/t of sodium silicate for a period of 2 minutes at 2100 rpm. Thereafter, there was added to the suspension of the ore either a standard reagent, being 260 g/t of tall oil fatty acid or a test reagent i.e. the reagent of the invention, being 220 g/t of tall oil fatty acid premixed with 5-26 g/t of nonylphenylethoxylate having 12-15 ethoxylate groups. There was also added to the suspension either 50 g/t (for the standard reagent) or 35 g/t (for the test reagent) of nonylphenylethoxylate having 4 ethoxylate groups. The pH of the suspension was greater than 7. A gas was introduced into the suspension to cause the formation of the froth and the suspension was floated until the froth was clean.

The metallurgical results obtained are given below in Table 1.

TABLE 1

| STANDARD REAGENT | | TEST REAGENT | |
|---|---|---|---|
| GRADE $P_2O_5$ | RECOVERY $P_2O_5$ | GRADE $P_2O_5$ | RECOVERY $P_2O_5$ |
| 36.4% | 80.6% | 36.4% | 90.5% |
| 36.4% | 80.7% | 36.4% | 91.4% |
| | | 36.4% | 91.2% |

TABLE 1-continued

| STANDARD REAGENT | | TEST REAGENT | |
|---|---|---|---|
| GRADE $P_2O_5$ | RECOVERY $P_2O_5$ | GRADE $P_2O_5$ | RECOVERY $P_2O_5$ |
| Average 80.7% | | Average 91.0% | |

The results show that using the test reagent, the recovery of phosphate values increased by 10.3%. Further, there was a saving of 15% in tall oil fatty acid consumption and a saving of 30% in the consumption of nonylphenylethoxylate having 4 ethoxylate groups. This obviously resulted in a saving in costs.

Thus the advantages of the process of the present invention are that one can achieve an improvement in metallurgical efficiency in the form of improved recoveries with a lower consumption of reagents which clearly leads to a reduction in costs.

We claim:

1. A process for recovering phosphate values from a finely divided ore containing the phosphate values and gangue by froth flotation includes the steps of:

(1) suspending the finely divided ore containing the phosphate values and the gangue in a liquid at a pH of greater than 7;

(2) adding to the suspension a froth flotation collector comprising:

(a) a tall oil fatty acid; and (b) an emulsifier for the tall oil fatty acid selected from alkylphenylalkoxylates having the formula

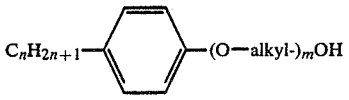

wherein:

n is an integer from 8-10 inclusive;

m is an integer from 10-20 inclusive; and alkyl is $—CH_2—CH_2—$ or

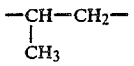

the froth flotation collector comprising 80 to 99% by weight tall oil fatty acid and 20 to 1 by weight emulsifier;

(3) introducing a gas into the liquid to produce a froth containing the phosphate values and leaving suspended the other solid gangue; and (4) recovering the phosphate values.

2. A process according to claim 1 wherein the tall oil fatty acid and the emulsifier are mixed with each other and are then added to the suspension in step (2).

3. A process according to claim 1 wherein the alkylphenylalkoxylate is an alkylphenylethoxylate having 12 to 15 ethoxylate groups.

4. A process according to claim 1 wherein the alkylphenylalkoxylate is nonylphenylethoxylate having 14 ethoxylate groups.

5. A process according to claim 1 wherein the froth flotation collector comprises 90 to 95% by weight tall oil fatty acid and 10 to 5% by weight emulsifier.

6. A process according to claim 1 wherein the froth flotation collector is added to the finely divided ore in an amount such that the froth flotation collector provides 200 to 600 g of the tall oil fatty acid per ton of the ore and 10 to 120 g of the alkylphenylalkoxylate per ton of the ore.

7. A process according to claim 6 wherein the froth flotation collector is added to the finely divided ore in an amount such that it provides an amount of 260 g of the tall oil fatty acid per ton of the ore and 13 g of the alkylphenylalkoxylate per ton of the ore.

8. A process according to claim 1 wherein the ore is ground to a particle size such that at least 70% of the particles of the ore have a particle size of less than 212 μm.

9. A process according to claim 8 wherein the ore is ground to a particle size such that at least 90% of the particles of the ore have a particle size of less than 425 μm.

10. A process according to claim 1 wherein the ore includes apatite, calcite and dolomite.

11. A process according to claim 10 wherein the ore includes in addition phlogopite, serpentyn, diopside and pyroxenite.

12. A process according to claim 1 wherein prior to step (2) the suspension of the ore in the liquid is treated with sodium silicate.

* * * * *

UNITED STATES PATENT AND TRADEMARK OFFICE

CERTIFICATE OF CORRECTION

PATENT NO. : 4,732,666

DATED : March 22, 1988

INVENTOR(S) : Welmegoed et al.

It is certified that error appears in the above-identified patent and that said Letters Patent is hereby corrected as shown below:

Column 1, line 43, change "oil" to --oils--.

Column 1, line 47, after "separating" insert --calcite--.

Column 3, line 39, before "+425μm" delete "10".

Signed and Sealed this

Twenty-third Day of August, 1988

*Attest:*

DONALD J. QUIGG

*Attesting Officer*

*Commissioner of Patents and Trademarks*